United States Patent [19]

Griffith

[11] 4,372,069

[45] Feb. 8, 1983

[54] IDENTIFICATION DEVICE

[76] Inventor: Oliver C. Griffith, 138 Shore Rush Dr., St. Simons Island, Ga. 31522

[21] Appl. No.: 207,475

[22] Filed: Nov. 17, 1980

[51] Int. Cl.[3] ..... G09F 11/00

[52] U.S. Cl. ..... 40/490; 40/611

[58] Field of Search ..... 40/490, 491, 611, 374, 40/1.6

[56] References Cited

U.S. PATENT DOCUMENTS

| | | | |
|---|---|---|---|
| 479,758 | 7/1892 | Gunn | 40/374 |
| 561,231 | 6/1896 | Lean et al. | 40/611 |
| 736,159 | 8/1903 | Seidensticker et al. | 40/405 |
| 2,884,713 | 5/1959 | Campbell | 40/374 |
| 3,166,042 | 1/1965 | Hill | 40/490 |
| 3,995,387 | 12/1976 | Lotts | 40/374 |
| 4,171,584 | 10/1979 | Kaiser | 40/490 |
| 4,219,952 | 9/1980 | Flath | 40/611 |

FOREIGN PATENT DOCUMENTS

| | | | |
|---|---|---|---|
| 664182 | 6/1963 | Canada | 40/490 |
| 448716 | 4/1968 | Sweden | 40/491 |
| 895585 | 5/1962 | United Kingdom | 40/490 |

*Primary Examiner*—Gene Mancene
*Assistant Examiner*—John J. Wilson
*Attorney, Agent, or Firm*—Harness, Dickey & Pierce

[57] ABSTRACT

An identification device that permits the user to maintain on his person a variety of individual bits of information. The device includes a body portion having recesses in which pieces carrying individual bits of information may be inserted at the user's will. Indicia is formed on the pieces and is viewable through suitable means in the body portion. A combined retention device and insertion and removal tool is affixed to the body portion and serves to retain the pieces in the recesses.

2 Claims, 4 Drawing Figures

3
3
11
12
13
14
15
16
17
18
19
21
22
23
24
25
26
27
28
29
31

IDENTIFICATION DEVICE

BACKGROUND OF THE INVENTION

This invention relates to a identification device, and more particularly to an improved and simplified device whereby a user may carry on his person in a convenient fashion a variety of different identification and information.

With modern day life it is not uncommon for an individual to be required to carry on his person a variety of identifying data. Such data consists of drivers license, credit cards, and the like, each of which normally has a different identifying number. In addition, there are certain numbers associated with a person's day-to-day life which he is called upon to use, such as phone numbers, social security number, numbers of various bank accounts, ZIP codes, addresses, and the like. Thus, each individual must carry with him at all times a variety of individual bits of information normally contained on separate cards or registers. The inconvenience of this is believed to be readily apparent Recently, pocket calculators have been provided which have memory capacity and can store the abovedescribed information. Such devices are, however, are costly and, in the event that the unit is switched off or the battery goes dead, the data is lost.

It is, therefore, a principal object of this invention to provide an improved, simplified and low cost identification device which permits the user to conveniently carry on his person in a simplified manner a number of bits of information.

It is a further object of this invention to provide an identification device which can be easily carried on the person and which permits ease of change or modification of the data retained in it.

SUMMARY OF THE INVENTION

This invention is adapted to be embodied in an identification device for assisting an individual in retaining a plurality of bits of information. A body portion is incorporated that is of a size which may be conveniently carried on the person and which defines a plurality of recesses adapted to receive parts formed with indicia for displaying the bits of information. The body portion further has means for permitting the user to see the indicia of the pieces when received in the recesses. Retention means are also incorporated for retaining the parts in the recesses.

DETAILED DESCRIPTION OF THE PREFERRED EMBODIMENT

Figures 1, 2, 3, 4:
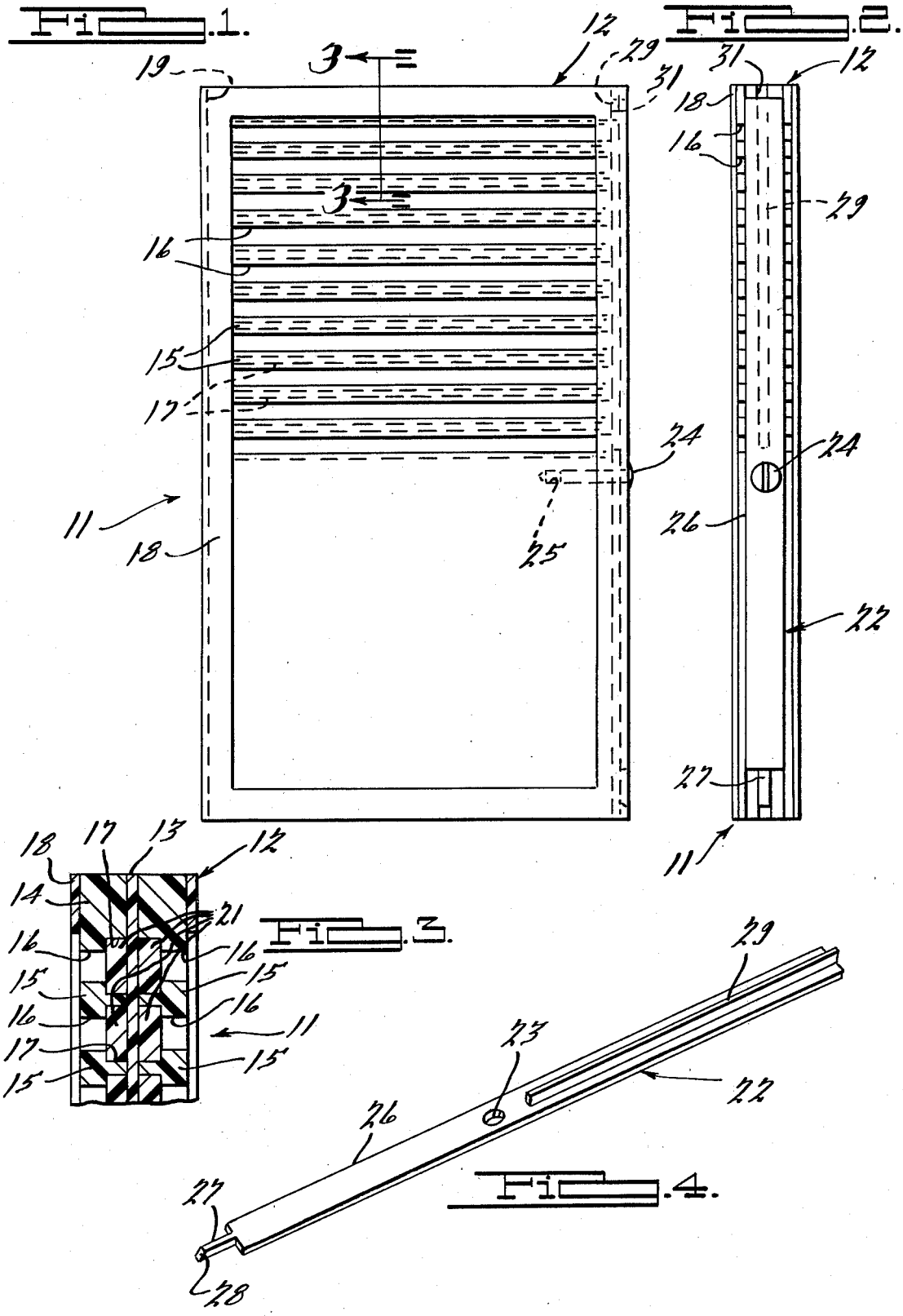
FIG. 1 is a front elevational view, on a somewhat enlarged scale, of an identification device embodying this invention.
FIG. 2 is a side elevational view of the device.
FIG. 3 is an enlarged cross-sectional view, taken along the line 3—3 of FIG. 1.
FIG. 4 is a perspective view, on an enlarged scale, of the combined retention device and insertion and removal tool.

The reference numeral 11 indicates generally an identification device embodying this invention. The identification device 11 includes a body portion, indicated generally by the reference numeral 12, which is of a laminated construction. The body portion 12 is generally rectangular in shape and is relatively thin and of a size so as to be conveniently carried on the person. The size may depend upon the particular application and it is believed that those skilled in the art may readily perceive this.

The body portion 12 is of a laminate constructed as best shown in FIG. 3. The laminate consists of a solid center piece 13 which has affixed to it on opposite sides a number of horizontally extending members consisting of top and bottom members 14 and intermediate members 15. The members 14 and 15 have opposing surfaces that are spaced about to define horizontally extending slots 16 on each face of the device 11 for a purpose to be described. At the base of each slot 16, recesses are formed by the members 14 and 15 so as to define a plurality of horizontally extending recesses 17 at the base of each slot 16. Marginal pieces 18 having open centers are affixed to opposite sides of the device 11 to form, in effect, an opaque border. The lefthand side of the device 11, as seen in FIG. 1, is also provided with an insert 19 which extends between the opposite sides of the marginal pieces 18 so as to close completely this side of the device, and specifically to form a closure for the slots 16 and recesses 17.

If desired, identifying legend may be formed along the marginal pieces 18 on the horizontal and vertical edges adjacent each of the slots 16 so as to afford the user a reference as to the material displayed through each slots 16. The displayed material is contained on a plurality of individual insert pieces 21 which may be inserted into the recesses 17 in a manner to be described. Each of the pieces 21 may be formed with either a letter of the alphabet, a number, or some other desired legend on one or both of its faces of a height which is something less than the height of the slot 17 so that the legend on each piece 21 may be readily viewed by the user through the slot 16. A certain number of blank pieces may also be employed to provide spaces between adjacent legends and/or to indicate voids. A combined retainer and tool, indicated generally by the reference numeral 22, is carried at the righthand side of the device 11, as viewed in FIG. 1. The retainer and tool 22 is formed with a center aperture 23 through which a screw 24 of the like may pass. The body portion intermediate member 13 is provided with a tapped hole 25 into which the threads of the screw 24 extend so as to affix the screw 24 and retainer and tool 22 to the body portion 12. As may be seen in FIG. 4, the retainer and tool 22 has a main body portion 26 that has a width equal to the combined depth of the recess 17 and a length which is just slightly shorter than the overall length of the body 12. A narrow projecting end 27 is formed at one end of the retainer and tool 22 which has a chisel-like end 28 and a width which is equal to or less than the width of the slots 16. The end 27 may then be inserted by a user through the slot 16 when the retainer and tool 22 is disassembled from the body 12 and placed behind the pieces 21 so that to slide them out of the open righthand side of the device 11.

The end of the retainer and tool 22 opposite the end 27 has a generally "T" shape cross-section which includes a raised rib 29. The rib 29 is a width equal to or less than the width of the slots 16 so that this end of the tool may be inserted with the leg 29 extending through the slots 16 and the main body portion 26 of this end received in the recess 17 so as to slide pieces 21 along each recess 17 for loading.

The center body portion 13 is formed with a notch or recess 31 of length equal to the leg 29 so that a flush appearance is presented on the righthand side of the device 11 when the retainer and tool 22 is affixed to the body portion 12 by the screw 24.

The device 11 is used in the following fashion. The body portion 12 with attached retainer and tool 22 is supplied with a plurality of pieces 21 containing a variety of information such as individual letters of the alphabet, numerals, dashes, slashes, and/or blank spaces. To insert the desired information into a body portion 12, the user removes the tool 22 by disengaging the screw 24 from the threads 25. To facilitate this, the head of the screw 24 may be sized so that a coin can be used for this purpose. Once the tool 22 is removed, the righthand side of the device is opened and free access to the recess 17 is afforded. Individual pieces 21 carrying the desired information may then be inserted into a recess 17 and forced along them toward the lefthand side, as viewed in FIG. 1, through the use of the end of the tool 22 having the projecting leg 29. The tool 22 is inserted so that the leg 29 extends outwardly through the slot 16. Once the desired information is placed into each of the recesses 17, the tool 22 is reassembled to the body portion 12 by insertion of the screw 24.

At any time the user desires to change any of the information contained in the device 11, the tool 22 is again removed. The end 27 can be used to remove the pieces 21 by inserting the wedge-shaped edge between adjacent of the pieces 21 through the slots 16. The pieces 21 may then be slid out of the opened righthand side and new pieces inserted.

It should be readily apparent from the foregoing description that a relatively simple, low cost device has been provided for affording an individual to carry on his person a side variety of information whoch cannot be inadvertently displaced or lost, and which may be conveniently changed at the user's will. Of course, the foregoing is that of a preferred embodiment of the invention and various changes and modifications may be made by those skilled in the art without departing from the spirit and scope of the invention as defined by the appended claims.

I claim:

1. An identification device for assisting an individual in retaining a plurality of bits of information comprising a body portion of a size that may be conveniently carried on the person, said body portion being a laminated construction comprised of a substantially imperforate center member having a generally rectangular shape, and a plurality of transversely extending members affixed to opposite sides of said center member, said transversely extending members and said center members defining a plurality of inverted "T" shaped slots extending across opposite faces of said body portion, the cross legs thereof forming a plurality of independent recesses in said body portion adapted to receive parts formed with indicia for displaying the bits of information, means for permitting the user to see the indicia on the pieces when received in said recesses comprising the upstanding legs of said "T" shaped slots, means providing a fixed closure for one end of said inverted "T" shaped slots affixed to said center member and said transversely extending members, and retention means providing a closure for the other end of said "T" shaped slots, release of said retention means being effective to permit parts to be inserted or removed from a selected one of said recesses without necessitating removal of parts from the remainder of the recesses, said retention means comprising an elongated member having a cross-section of one of its ends of a configuration complimentary to the inverted "T" shaped slots for facilitating insertion of the pieces therein.

2. An identification device as set forth in claim 1 wherein the other end of the retention means is formed with a portion having a configuration adapted to extend through the upstanding leg of the inverted "T" shaped slots for facilitating removal of the pieces therefrom.

* * * * *